United States Patent [19]

Carson

[11] Patent Number: 4,803,603

[45] Date of Patent: Feb. 7, 1988

[54] PLASTER FRAME

[75] Inventor: Douglas W. Carson, Downey, Calif.

[73] Assignee: Thomas Industries, Inc., Los Angeles, Calif.

[21] Appl. No.: 156,324

[22] Filed: Feb. 16, 1988

[51] Int. Cl.[4] ..... F21S 1/02

[52] U.S. Cl. ..... 362/150; 362/366; 362/404

[58] Field of Search ..... 362/145, 147, 148, 150, 362/364, 365, 366, 404, 457

[56] References Cited

U.S. PATENT DOCUMENTS

| | | | |
|---|---|---|---|
| 3,422,261 | 1/1969 | McGinty et al. | 240/78 |
| 3,700,885 | 10/1972 | Bobrick | 362/366 |
| 3,755,667 | 8/1973 | Price | 362/147 |
| 4,293,895 | 10/1981 | Kristofek | 362/147 |
| 4,313,154 | 1/1982 | Capostagno et al. | 362/147 |
| 4,336,575 | 6/1982 | Gilman | 362/147 |
| 4,408,262 | 10/1983 | Kusmar | 362/147 |

FOREIGN PATENT DOCUMENTS

| | | | |
|---|---|---|---|
| 2383394 | 11/1978 | France | 362/404 |
| 0120984 | 9/1979 | Japan | 362/147 |

OTHER PUBLICATIONS

Pp. 2 and 3 of Applicant's Brochure CR-286, of Jul. 19, 1986.

*Primary Examiner*—Ira S. Lazarus
*Assistant Examiner*—Sue Hagarman
*Attorney, Agent, or Firm*—Hill, Van Santen, Steadman & Simpson

[57] ABSTRACT

A plaster frame or base for recessed lighting fixtures has hanger bar receiving corners which are bendable to accommodate parallel or perpendicular axis orientation relative to ceiling joists or suspension grids. The frame spans the space between a pair of hanger bars and its corners have a plurality of mountings to accommodate different types of hanger bar such as flat horizontal, flat vertical, and adjustable interlocking hanger bars. The frame is preferably a rectangular metal plate with a flat base having upstanding side flanges, a fixture receiving aperture through the base between the flanges having a depending skirt or collar to surround and mount the fixture, mountings on the base for a junction box adjacent the aperture, and bendable hanger bar securing corners. The plate is sufficiently narrow to fit through the conventional ceiling aperture for the fixture.

18 Claims, 3 Drawing Sheets

PLASTER FRAME

FIELD OF THE INVENTION

This invention relates to the art of mounting recessed lighting fixtures and specifically deals with a universal plaster frame or base plate carrying the lighting fixture and a junction box and having bendable hanger bar receiving corners accommodating alternate alignments of the fixture assembly relative to ceiling joists or grids.

BACKGROUND OF THE INVENTION

Heretofore plaster frames or base plates for recessed lighting fixtures were not universally suitable for all types of installation and had to be supplied in different configurations to accommodate different alignment requirements. This frequently resulted in installation delays because the installer did not have a modified frame or base for a particular installation. Further, the necessity for manufacturing and maintaining inventories of many different types of frames or base plates caused confusion and greatly increased the costs.

Further, the prior known plaster frames or base plates for recessed lighting fixtures were too wide for insertion through the fixture receiving ceiling aperture and had to be provided with a break out section opening up a gap permitting the plate to straddle the ceiling and then be rotated through the aperture. This procedure was, of course, quite awkward.

It would therefore be an improvement in this art to provide a universe plaster frame or base plate for recessed lighting fixtures accommodating all different types of hangers and installation orientations and capable of being inserted through fixture receiving ceiling apertures without modification.

SUMMARY OF THE INVENTION

According to this invention, a plaster frame or base plate for recessed lighting fixtures has bendable hanger bar receiving corners accommodating all conventional types of hanger bars and adapted to extend axially or laterally to accommodate axial or transverse installations and to fit through conventional ceiling apertures for recessed lighting fixtures.

The preferred frame is a flat metal plate of generally rectangular configuration having a base with upstanding flanges or skirts along the sides thereof, a lighting fixture receiving aperture through the base between the flanges having a depending integral collar, a flat junction box receiving area on the base along one side of the aperture, four independent corners each composed of end portions of the flanges and adjacent flat base portions and living hinge or bending zones connecting the flange portions of the corners to the main flanges. The corners thus have horizontal flat base portions and upright side portions and are adapted to bend along the hinge line from longitudinal or axial positions to transverse or lateral positions.

The ends of the flat plate are bent upwardly from the base providing transverse ribs between the corners. Fingers are lanced up from the base inwardly and parallel to the ribs to cooperate with the ribs to straddle overlying hanger bars.

The corners are provided with slots and tangs for mounting the plate on all types of conventional hanger bars. Thus, the upstanding flange portions of the corners have outermost vertical slots with outwardly opening gaps to receive conventional extensible hanger bars which rest on the base portions of the corners. Vertical closed periphery slots are provided inwardly from the gapped slots to receive flat vertical hanger bars resting on the flat base portions of the corners. These base portions then have lanced out tabs depending therefrom to straddle underlying horizontal flat type hanger bars on which rest the base portions of the corners.

The flat base portion of the plate has circumferentially spaced upstanding tangs or ears around the aperture and the flat base area alongside the aperture has tang receiving slots. The "Can" or housing of the recessed lighting fixture fits snugly through the aperture surrounded by the collar and is secured to the plate by fasteners anchored in the upstanding tangs or ears around the aperture.

A junction box is conveniently mounted on the flat end portion of the plate between the flanges by means of tangs depending from the box through the slots in the base.

The hanger bars are conventionally mounted on spaced parallel ceiling joists, ceiling suspension grids and the like, spanning the space between the adjacent joists and grids. The plaster frame or base plate can slide along the hanger bars to the exact position desired for the recessed fixture and to register with a ceiling opening for the fixture.

In some installations the axis of the fixture is parallel to the joists or grid supports while in other installations this axis is perpendicular to the support joists or grids and in order to provide for alignment of the fixture in these different installations it is necessary to change the axis position of the frame between the joists or grids. This is accomplished by leaving the corners in their longitudinal positions to have the axis parallel with the joists and to bend the corners laterally outwardly at right angles to their longitudinal positions to have the axis perpendicular to the joists or grids.

Many different stamping patterns may be provided for the plaster frame but it is generally preferred to have a generally rectangular metal plate with sides converging from both sides of the collar at its transverse diameter so that the ends of the plate are narrower than the exterior diameter of the collar. This facilitates insertion of the plate through the ceiling aperture for the fixture.

The plaster frames or base plates of this invention may vary in size for different sized recessed lighting fixtures but are preferably formed of galvanized steel about 0.03125" to 0.0336" inches thick. For conventional cylindrical "Can" type recessed fixtures, the plate will have a length of about 10.19" to 10.21" inches, a maximum width of 6.39 to 6.42 inches, reduced width ends about 4.99 to 5.01 inches wide, upstanding flanges of about 0.89 to 0.91 inches high, an aperture of about 6.23 to 6.25 inches in diameter and a depending skirt or collar about 0.64 to 0.66 inches deep. The corners are about 0.88 to 1.00 inches long and 0.85 to 1.00 inches wide.

A preferred embodiment of the invention is illustrated in the drawings in which.

BRIEF DESCRIPTION OF THE PREFERRED ILLUSTRATED EMBODIMENT

Figure 1:
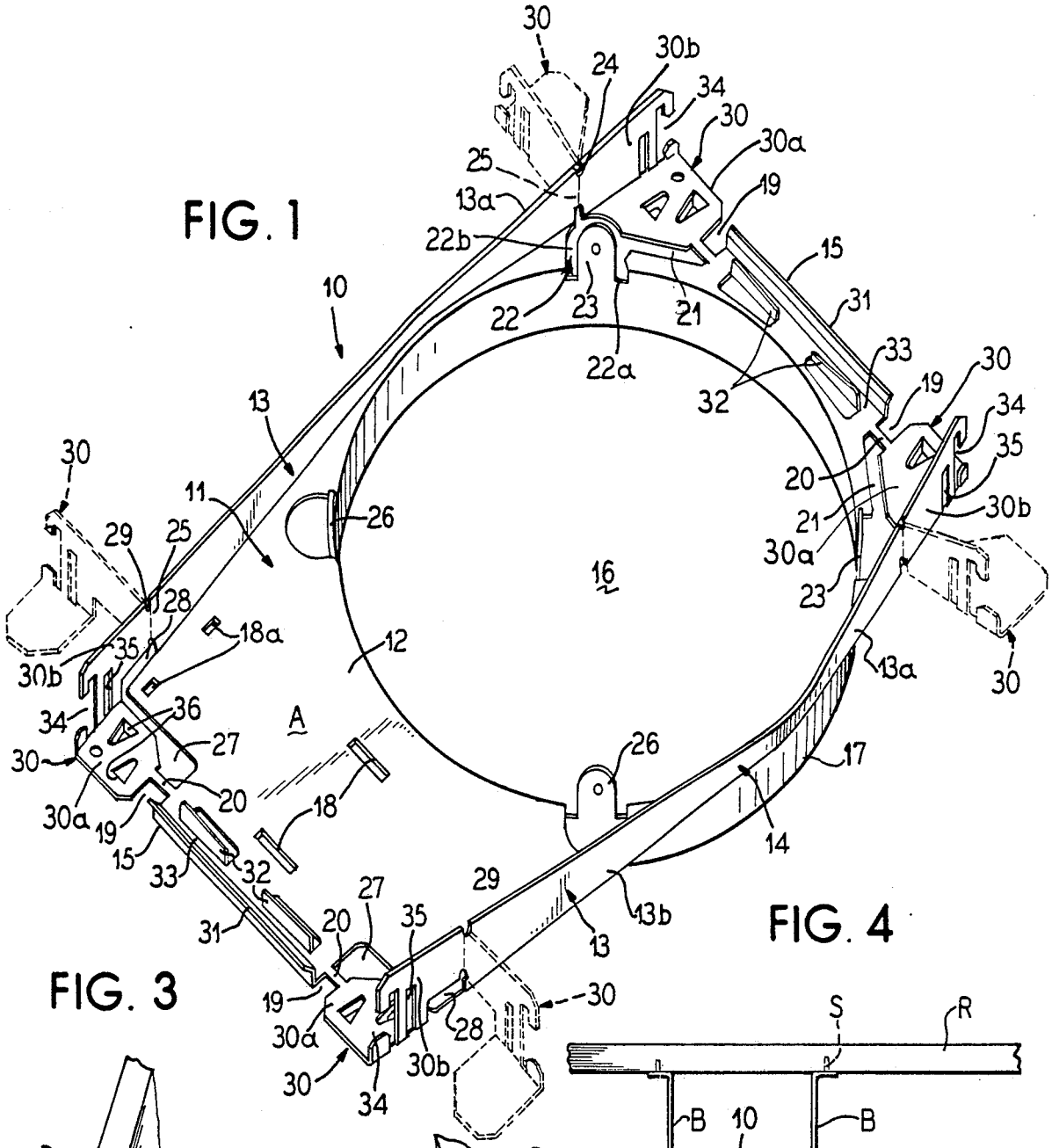
FIG. 1 is a top and side perspective view of a plaster frame or recessed lighting fixture base plate of this invention with dotted line illustrations of the corners of the plate showing the alternate mounting position.

In the drawings, the reference numeral 10 designates generally, a plaster frame of this invention for mounting a lighting fixture F on hanger bars B secured to adjacent spaced parallel joists or rafters R and spanning the space therebetween in spaced parallel relation or perpendicular to the rafters. As used herein, the term "rafter" or "joist" is intended to include suspended ceiling grids conventionally used in dropped ceiling mountings and other structural beams or building supports for electrical fixtures.

Figure 2:
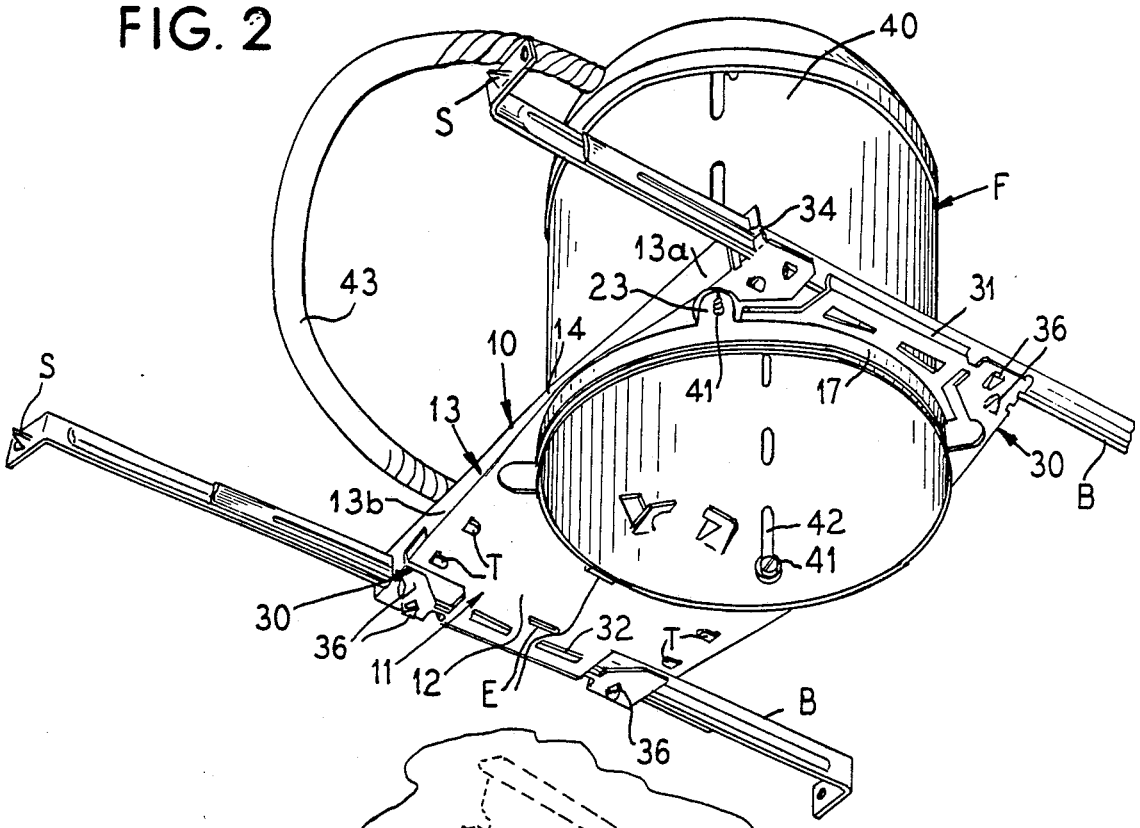
FIG. 2 is a side and bottom perspective view of the base plate of FIG. 1 carrying a cylindrical lighting fixture and conduit box and mounted on extensible hanger bars.

The plaster frame 10, as best shown in FIGS. 1 and 2, is a generally rectangular metal plate 11 with a flat base 12 having upturned flanges or skirts 13, 13 along the length thereof. The base has a wide intermediate portion 14 and tapers from this wide portion to narrower end portions 15, 15. Each flange 13 therefore has a short leg portion **13*a* converging from the wide portion 14 to one end 15 and a longer leg portion 13*b* converging from the wide portion 14 to the opposite end 15**.

A large diameter aperture 16 is provided through the wide portion 14 of the base 12 and is surrounded by an integral depending cylindrical collar 17. The positioning of the aperture 16 adjacent one end of the plate 11 provides a platform area A on the base for receiving a standard electrical junction box C. This box C has depending ears E (FIG. 2) extending into slots 18 in the platform A (FIG. 1) to center the box on the platform and tangs T locked in slots **18*a* to secure the box to the base 12**.

Each corner of the base is separated therefrom by a slot 19 extending axially or longitudinally inward from the end 15 to a narrow transverse break away bridge 20. At one end 15 (the top end of FIG. 1), a diagonal slot 21 extends axially inwardly and radially outwardly from the bridge 20 to a U-shaped slot 22 having legs **22*a* and 22*b* opening into the aperture 16 and thus providing a tab 23 which is bent upwardly at the top of the collar. The slot leg 22*b* is extended into the adjacent flange leg 13*a* and a notch 24 is cut in the top edge of the flange leg 13*a* to provide a bending line 25** in the flange between the notch and slot leg.

Two other upstanding tabs 26 are lanced from the platform A at the collar 17 to provide four equal circumferentially spaced tabs extending above the collar.

The opposite platform end 15 of the base 12 has a slightly modified slot inwardly from the bridge 20 which extends radially as shown at 27 to the longer arm **13*b* of the flange 13 and then extends longitudinally at 28 in the corner between the base 12 and the flange 13. A notch 29, identical with the notch 23, is formed in the top edge of the flange 13 just above the inner end of the slot 28 to provide the same type of bending line 25** as is provided at the opposite end of the base.

The slots 19, 21, 22 and 19, 27, 28 thus provide four independent corner tabs 30 each having a bottom base segment **30*a* and an upstanding flange segment 30*b* and which, when the bridge 20 is severed, can swing about the hinge line 25** from an axially extending position to the radially extending position.

The portions of the ends 15 between the slots 19 are turned upwardly to provide tranverse ribs 31. The base 12 adjacent each rib 31 is lanced to provide a pair of transverse tangs 32 paralleling the rib 31 and providing therebetween a track 33 for a hanger bar as will later be described.

Each corner 30 has an outwardly opening "C" shaped vertical slot 34 in the flange portion **30*b* thereof aligned with the track 33. A closed periphery vertical slot 35 is also formed through each flange portion 30*b* in spaced parallel relation behind the "C" shaped slot 34**.

The base **30*a* of each corner 30 has a pair of confronting tangs 36 lanced therefrom and cooperating to define a hanger bar strap under each corner base 30*a***.

Figure 3:
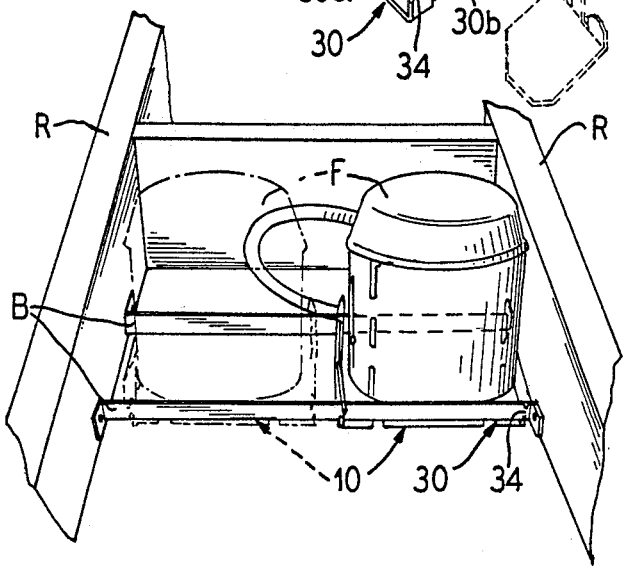
FIG. 3 is a side and top fragmental perspective view showing the plaster frame mounting between ceiling joists or rafters on an axis parallel with the joists.

The "C" shaped slots 34 and the tracks 33 receive adjustable interlocking vertical hanger bars B (FIG. 2) to suspend the plaster frame from the rafters R as illustrated in FIG. 3. In this illustrated arrangement, the corners 30 are in their normal axially extending positions and the plaster frame has its axis parallel to the rafters and adjustable along the length of the hanger bars to align the lighting fixture with a ceiling aperture.

Figure 4:
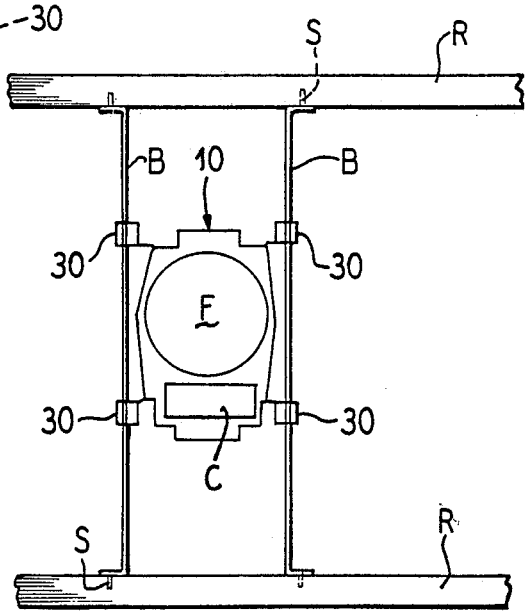
FIG. 4 is fragmentary top diagrammatic view similar to FIG. 3 of a perpendicular axis mounting between joists accommodated by the plaster frame of this invention.

When the corners 30 are bent laterally outward on their hinge lines 25, these slots 34 open laterally outward and receive the expansible hanger bars B along the sides of the plaster frame instead of along the ends. Thus, an outturned corner at one end of the plaster frame, cooperates with a corresponding outturned corner at the opposite end of the frame to suspend the frame from the hanger bar B and provide a perpendicular axis mounting between joists or rafters R at right angles to the rafters or joists illustrated in FIG. 3, as shown in FIG. 4. The transverse or perpendicular axis arrangement permits the lighting fixture to be moved into alignment with a ceiling aperture between the joists.

As illustrated in FIG. 2, the adjustable hanger bars B each have a pair of slidably connected strips with spikes S on their ends which are driven into the rafters R (FIGS. 3 and 4) to mount the bars in an upright vertical position.

Figure 6:
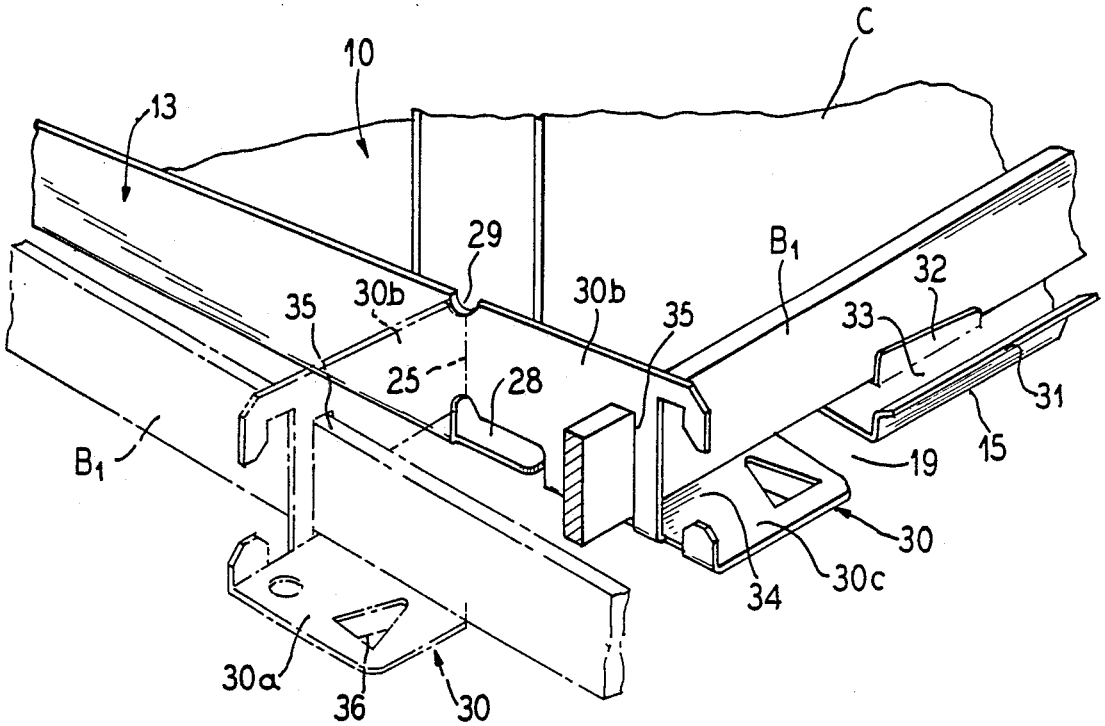
FIG. 6 is a fragmentary front corner perspective view illustrating the manner in which the plaster frame is mounted on flat vertical hanger bars in alternate axial positions.

As shown in FIG. 6, each corner 30 also accommodates the so-called flat vertical hanger bar $B_1$ which overlies the plaster frame and extends through the closed periphery slot 35 of the corner flange **30*b*. The corners 30**, of course, can be positioned axially, as illustrated in solid lines or bent laterally outward, as illustrated in dotted lines to suspend the plaster frame from the vertical hanger bars $B_1$ on parallel or perpendicular axes between the rafters or joists.

Figure 7:
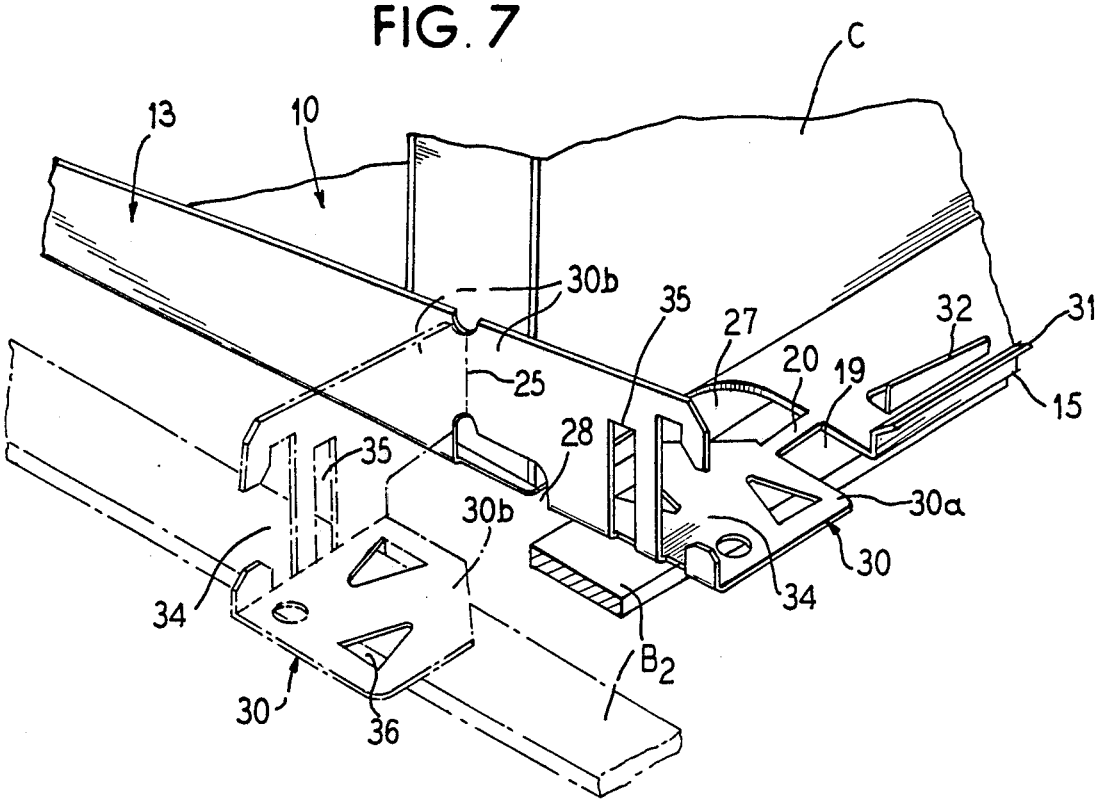
FIG. 7 is a view similar to FIG. 6 but illustrating the manner in which the plaster frame may be alternately mounted on horizontal flat hanger bars.

As shown in FIG. 7, the plaster frame 10 is also capable of being mounted on horizontal flat hanger bars $B_2$ . In this arrangement the frame is positioned on the top of the flat bars and the downturned tangs 36 of the base portions **30*a* of the corners 30** lap around the sides of the hanger bars $B_2$ providing a guide track for the hanger bars and holding the plaster frame to span the space between the parallel hanger bars.

It will thus be understood from the showings in FIGS. 2, 6 and 7, that the plaster frame corner accommodates conventional different types of hanger bars.

As shown in FIG. 2, the can 40 of the lighting fixture F snugly fits in the collar 17 of the plaster frame 10 and is secured to the collar by screws 41 extending through slots 42 thereof and threaded into the tangs 23 and 26 of the collar. The slots 42 accommodate raising and lowering of the can 40 relative to the plaster frame 10. A lighting socket (not shown) in the dome of the can 40 is connected through an external Bx conduit 43 with the conduit box C mounted on the platform portion A of the plaster frame.

Figure 5:
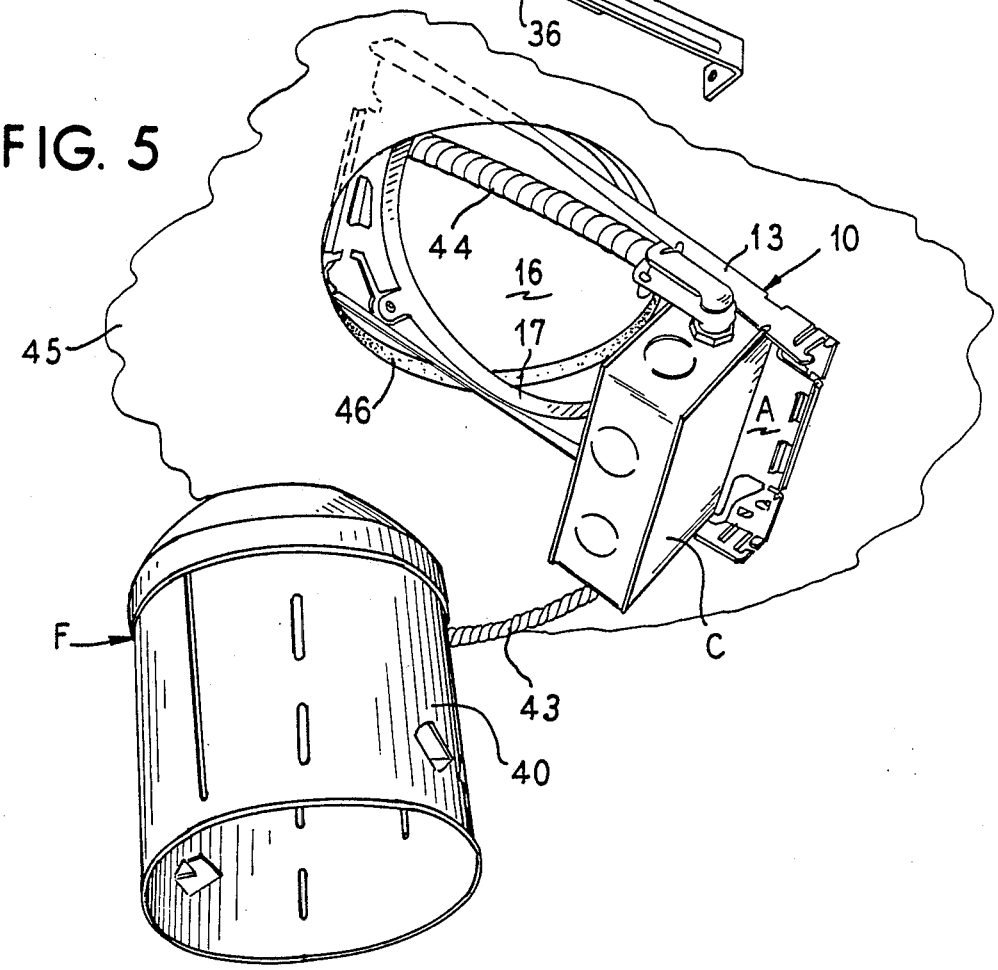
FIG. 5 is a perspective view illustrating the manner in which the plaster frame is easily inserted through a ceiling opening for the recessed lighting fixture.

As illustrated in FIG. 5, the plaster frame 10 with the conduit box C thereon coupled to the socket in the demounted plaster can 40 through the Bx conduit 43 and to an electrical conduit 44 emerging from above the ceiling 45 through a fixture aperture 46, is easily inserted through the ceiling aperture sized for the recessed lighting fixture without interference since the narrow plaster frame of this invention fits easily through this aperture. The frame is then mounted on the hanger bars above the ceiling and the fixture is pushed through the aperture 16 and secured to the frame by the screws 41. The fixture is then mounted for use.

From the above descriptions and illustrations of the drawings, it should be understood that this invention provides a universal plaster frame for recessed lighting fixtures which will accommodate conventional hanger bars and parallel and perpendicular axis mountings. While a particular embodiment of the plaster frame has been described and illustrated in detail, it should be understood that many different stamping designs are available to accommodate the formation of the bendable corners from a sheet metal plate and that apertures of different shapes and sizes can be formed in the plate for different types of recessed lighting fixture.

It will therefore be understood that the scope of this invention is to be determined only as defined in the claims.

I claim as my invention:

1. A plaster frame for recessed lighting fixtures which comprises a flat metal plate, an aperture through the plate, a collar depending from the aperture, and bendable corners on the plate swingable from axial to transverse positions and constructed and arranged to receive hanger bars for mounting the frame in axial and perpendicular orientations between joists.

2. A plaster frame for recessed lighting fixtures which comprises a generally rectangular metal plate having an apertured fixture receiving flat base with upturned side flanges, corners on the base swingable on said flanges from axial to transverse positions and means on said corners for selectively receiving different types of hanger bars to mount the frame between building joists.

3. A universal plaster frame for recessed lighting fixtures adapted for insertion through an opening sized to receive the fixture and for mounting axially parallel or perpendicular to ceiling joists on flat horizontal, flat vertical, and adjustable interlocking types of hanger bars which comprises a plate having a lighting fixture receiving aperture surrounded by an integral depending collar, upturned flanges on two sides of the plate, isolated corner portions on the plate having supports for any of such types of hanger bars and hinges connecting the corner portions with the flanges to selectively position the hanger bar supports to accommodate the axial and perpendicular mountings.

4. The frame of claim 3 wherein the corner portions have bases and flanges with hanger bar receiving means.

5. The frame of claim 3 wherein the corner portions swing from axial alignment with the plate to outturned lateral positions.

6. The frame of claim 3 including severable bridges connecting the corners to the plate.

7. The frame of claim 3 including a platform on the plate at one side of the aperture and means for mounting a conduit box on the platform between the flanges.

8. The frame of claim 3 wherein the plate is rectangular, the flanges are on the long sides of the plate and the ends of the plate are narrower than the inner portions.

9. The frame of claim 8 wherein the ends of the plate have hanger bar tracks between the corners.

10. The frame of claim 3 wherein the plate is a punched and stamped metal piece.

11. The frame of claim 3 wherein the hanger bar supports slidably receiving the hanger bars.

12. The frame of claim 2 wherein the corners have flat base portions and upstanding flange portions connected to the flanges and swingable thereabouts from axial to lateral positions.

13. The frame of claim 2 wherein the plate is a one piece metal stamping.

14. The frame of claim 2 wherein the base has a platform area alongside the aperture and means on the platform for anchoring a conduit box thereon.

15. The frame of claim 14 wherein said means for anchoring are tangs carried from the base.

16. The frame of claim 12 wherein the base portions of the corners are connected to the base of the plate by severable bridges.

17. A recessed lighting fixture assembly including the frame of claim 2 having a fixture can anchored in the aperture of the frame, a conduit box anchored on the flat base of the frame and an electrical conduit connecting the box and can.

18. The frame of claim 1 including tabs bent from the plate around the collar for receiving fasteners to secure the fixture in the collar.

* * * * *